US006672893B1

(12) United States Patent
Sedlecky et al.

(10) Patent No.: US 6,672,893 B1
(45) Date of Patent: Jan. 6, 2004

(54) MODULAR TERMINAL BLOCK ASSEMBLY

(75) Inventors: Daniel P. Sedlecky, Naperville, IL (US); Thomas Baum, Naperville, IL (US); Mohammed G. Aouf, Bolingbrook, IL (US)

(73) Assignee: Marconi Communications, Inc., Cleveland, OH (US)

( * ) Notice: Subject to any disclaimer, the term of this patent is extended or adjusted under 35 U.S.C. 154(b) by 0 days.

(21) Appl. No.: 10/335,120

(22) Filed: Dec. 31, 2002

(51) Int. Cl.[7] ..... H01R 11/20
(52) U.S. Cl. ..... 439/417
(58) Field of Search ..... 439/417, 701, 439/717, 594, 404, 405, 418, 412

(56) References Cited

U.S. PATENT DOCUMENTS 1,826,869 A * 10/1931 Everett ..... 439/717
4,652,070 A 3/1987 Suffi
5,302,137 A 4/1994 Suffi
5,449,299 A * 9/1995 Shimirak et al. ..... 439/417
5,451,170 A 9/1995 Suffi
5,597,321 A * 1/1997 Jacques ..... 439/417
6,015,312 A * 1/2000 Escane ..... 439/417
6,299,475 B1 * 10/2001 Huspeni et al. ..... 439/412

* cited by examiner

*Primary Examiner*—Renee Luebke
*Assistant Examiner*—Felix O. Figueroa
(74) *Attorney, Agent, or Firm*—Jones, Day

(57) ABSTRACT

A modular terminal block assembly including modular shells having channel shaped and walled ends, multiple housings for insulation displacements connectors and slotted partitions. A universal connector with extending parallel arms connect abutting modular shells, and barrier strips are located within the modular shells abutting the housings. End shells are also attached to the modular shells. Grease is placed in the housing and in activators mounted to the housings. The shells are filled with potting compound where the arms and partitions integral with the shells act as reinforcing elements in the compound. Thereafter the compound hardens so as to strengthen and stiffen the connected shells. This results in a robust assembly.

32 Claims, 11 Drawing Sheets

MODULAR TERMINAL BLOCK ASSEMBLY

CROSS REFERENCE TO RELATED APPLICATION

Not applicable.

STATEMENT RE FEDERALLY SPONSORED RESEARCH

Not applicable.

BACKGROUND OF THE INVENTION

1. Field of the Invention

The present invention relates to a modular terminal block assembly and more particularly, to a modular terminal block assembly which is robust, effective and economical.

2. Description of the Related Art

Terminal blocks are utilized in the telecommunications industry to provide an efficient connection for individual wires, line or conductors to individual pairs of lines of a multi-pair cable. Such terminal blocks may provide connection, for examples, between a multi pair cable from a central office and line pairs from neighboring subscriber locations.

The typical terminal block utilizes insulation displacement connectors sometimes called clips to make the connection. This type of connector pierces the insulation of a wire or conductor as the conductor is inserted into the terminal block by a tool called an activator. The other end of the clip is fixed to an electrical conductor from the cable. See, U.S. Pat. Nos. 5,451,170; 5302,137; and 4,652,070 for examples of terminal blocks with activators and insulation displacement connectors. The disclosures of these patents are incorporated herein by reference.

Terminal blocks are generally of different lengths depending upon requirements at a particular site. Also, terminal blocks are often used outdoors which require sealing of the electrical connections against adverse environmental conditions, especially moisture. In the past, terminal blocks were made of one piece shells to provide sufficient strength. Modular terminal block assemblies tended to have insufficient structural integrity thereby limiting the number of components or sections that were able to be joined together. Furthermore, modular terminal blocks could not hold environmental sealing well and thus was a constant concern since any moisture that works its way to the electrical connection between the conductor and the connector degrades that connection or causes a failure.

Efforts have been made in the past to improve upon the structure of modular terminal block assemblies but these prior attempts have yet to produce an optimal system.

BRIEF SUMMARY OF THE INVENTION

The difficulties encountered with previous devices have been overcome by the present invention. What is described here is a modular terminal block assembly comprising in combination first and second modular shells each having a base wall, and opposing side walls extending downwardly from the base wall, an insulation displacement connector housing mounted to the base wall including two chambers in the housing for receiving two insulation displacement connectors, a first connector element at an end portion of the each modular shell, a second connector element at a second end portion of the modular shells, and a plurality of partitions extending from each side wall toward the other side wall, insulation displacement connectors mounted in the housing chambers of the modular shells, two end shells having a connector element engageable with one of the connector elements of the first or second modular shell, a universal connector for joining the modular shells, the universal connector having two complementary connector elements, each to engage one of the connector elements of the modular shells, and two pairs of parallel extending arms for being disposed parallel to the opposing side walls of the modular shells, and each of the arms being engageable with a partition.

The assembly also includes two activators, each activator being operatively engaged with a corresponding insulation displacement connector housing of the modular shells for facilitating the connector of electrical conductors with the insulation displacement connectors, the activators having a covering of molded insulative material, barrier strips connected to the shells, the barrier strips having openings and slots for receiving the insulation displacement connectors and the partitions and for allowing the passage of potting compound, the barrier strips being positioned abutting the insulation displacement connector housings, insulative material placeable in the housings around the insulation displacement connectors above the barrier strips and in the activators, and potting compound located above and below the barrier strips.

A feature of the modular terminal block assembly that is described in detail below is that it is extremely robust with improved strength and stiffness. Other advantages of the disclosed modular terminal block assembly improved are economy and environmental sealing. Still another object of the modular terminal block assembly is that it may be made larger than previous modular block assemblies. Still other features of the disclosed modular terminal block assembly are improved conductor strain relief and better containment of gel or grease when the conductors are removed and inserted. A feature even includes a grease wiping action of the conductors upon removal of the conductors from the modular terminal block assembly.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figures 1, 2, 3, 4, 5:
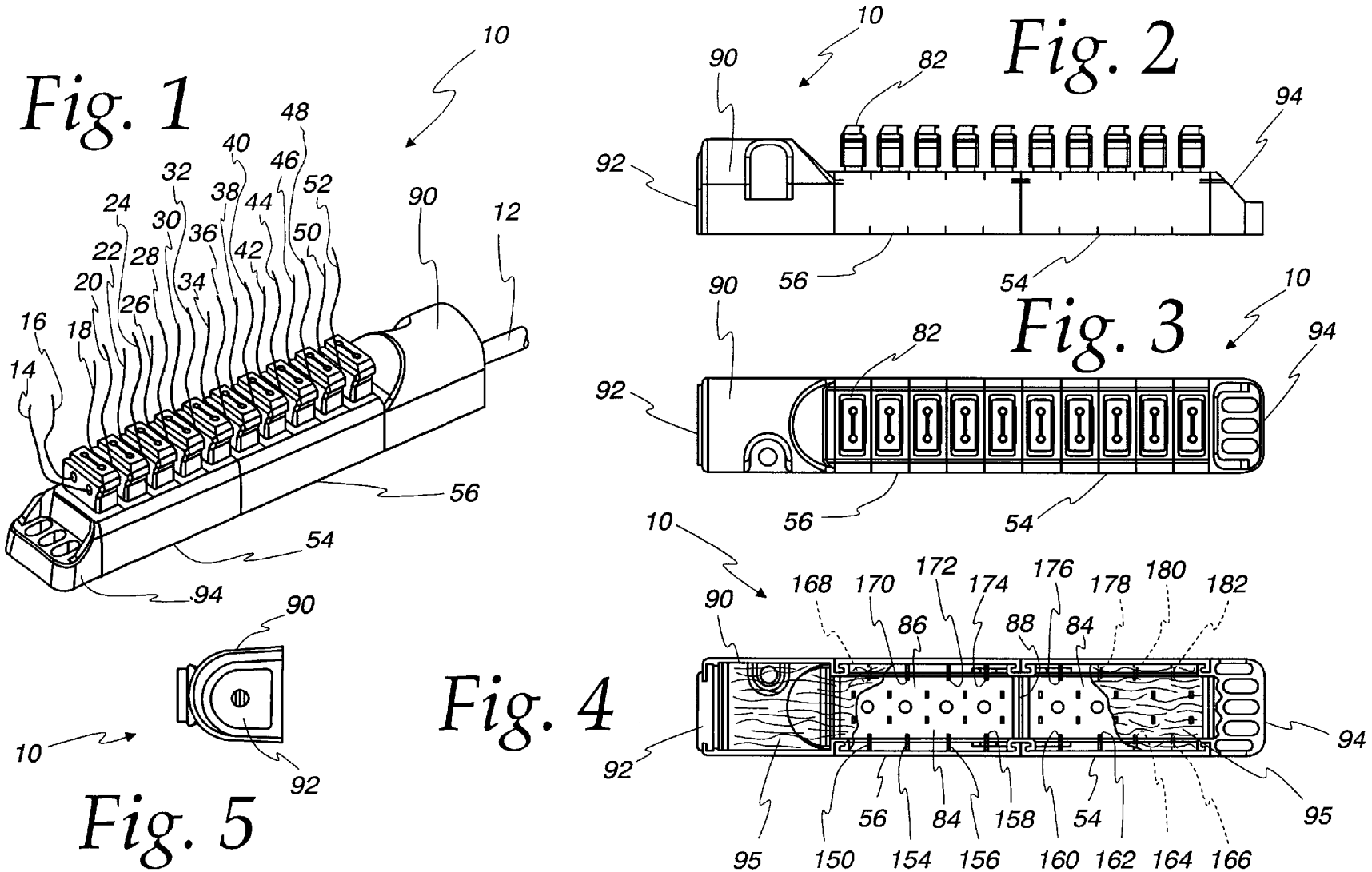
FIG. 1 is a downward looking isometric view of a modular terminal block assembly disclosed herein featuring ten line pairs.
FIG. 2 is a side elevation view of the modular terminal block assembly shown in FIG. 1 after rotation by about one hundred eighty degrees.
FIG. 3 is a top plan view of the modular terminal block assembly shown in FIGS. 1 and 2.
FIG. 4 is a bottom plan view of the modular terminal block assembly shown in FIGS. 1–3 but partially broken away.
FIG. 5 is an end elevation view of the modular terminal block assembly shown in FIGS. 1–4.

While the present invention is open to various modifications and alternative constructions, the preferred embodiment shown in the various figures of the drawing will be described herein in detail. It is understood, however, that there is no intention to limit the invention to the particular embodiment, form or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Referring now to FIGS. 1–6, a fully assembled modular terminal block assembly 10 as well as its individual components are illustrated. As explained above, the terminal block assembly may be used to receive a cable 12 from a central office, for example, that contains multiple line pairs that may be used for telephone service. These multiple line pairs are divided in the terminal block assembly to single pairs, such as the ten pairs of lines, wires or conductors 14, 16, 18, 20, 22, 24, 26, 28, 30, 32, 34, 36, 38, 40, 42, 44, 46, 48, 50, 52. The line pairs may then be connected to an individual subscriber's location. The main purpose of the terminal block assembly is to allow such individual line pairs to be connected when service is desired and disconnected when service is discontinued. The terminal block assembly allows conductors to be installed and removed multiple times while maintaining the integrity of the electrical connection each time a conductor is installed.

In the particular modular terminal block assembly disclosed here, there are two modular shells 54, 56, each with integral insulation displacement connector housings 58, 60, 62, 64, 66 and 68, 70, 72, 74, 76 respectively. Within each housing is a pair of chambers, such as the chambers 73, 75, in the housing 58, FIG. 6 and a pair of insulation displacement connectors, such as the pair of connectors 78, 80, mounted in the chambers. Slideably mounted on the housings are a series of activators, such as the activator 82 on the housing 76. The activators being slidable over the housing facilitates the connection of a pair of lines to the insulation displacement connectors, which connectors in turn are connected to a pair of conductors making up the central office cable. Located within each of the modular shells is a barrier strip 84, 86 which abuts the lower end of the housings. As will be explained below, grease, gel or a combination of the two are installed in the housing and around the insulation displacement connectors and in the activators.

Connecting the two modular shells 54, 56 is a universal connector 88. While only two shells are shown connected with one universal connector, it is now apparent that three or more shells may be connected in the same way using additional universal connectors. It is also apparent now that in some installations only a single modular shell is used. It is to be further understood that the present invention is not limited to the particular shells shown, having five pairs of insulation displacement connectors and five housings each. A single shell may contain more or less housings and may be longer or shorter than the modular shells illustrated. Generally, terminal block assemblies are available in five, ten, twelve and twenty-five pair models. These may be formed of one shell, two shells of five housings each, three shells of four housings each, and five shells of five housing each, respectively. It is noted that the modular shells are essentially identical except for the number of housings and the shell's longitudinal length.

At one end of the modular terminal block assembly is a cable end cap 90 with its own insertable end wall 92. A smaller end cap 94 is connected at the opposite end of the assembly.

To ensure environmental integrity, a protective insulative material 95 often called a potting compound, fills the bottom portion of each of the modular shells beneath the barrier strips and also fills available openings or spaces in the end caps. Furthermore, the potting compound enters through the barrier strips into regions above the barrier strips between the housings and around the universal connectors.

Figure 6:
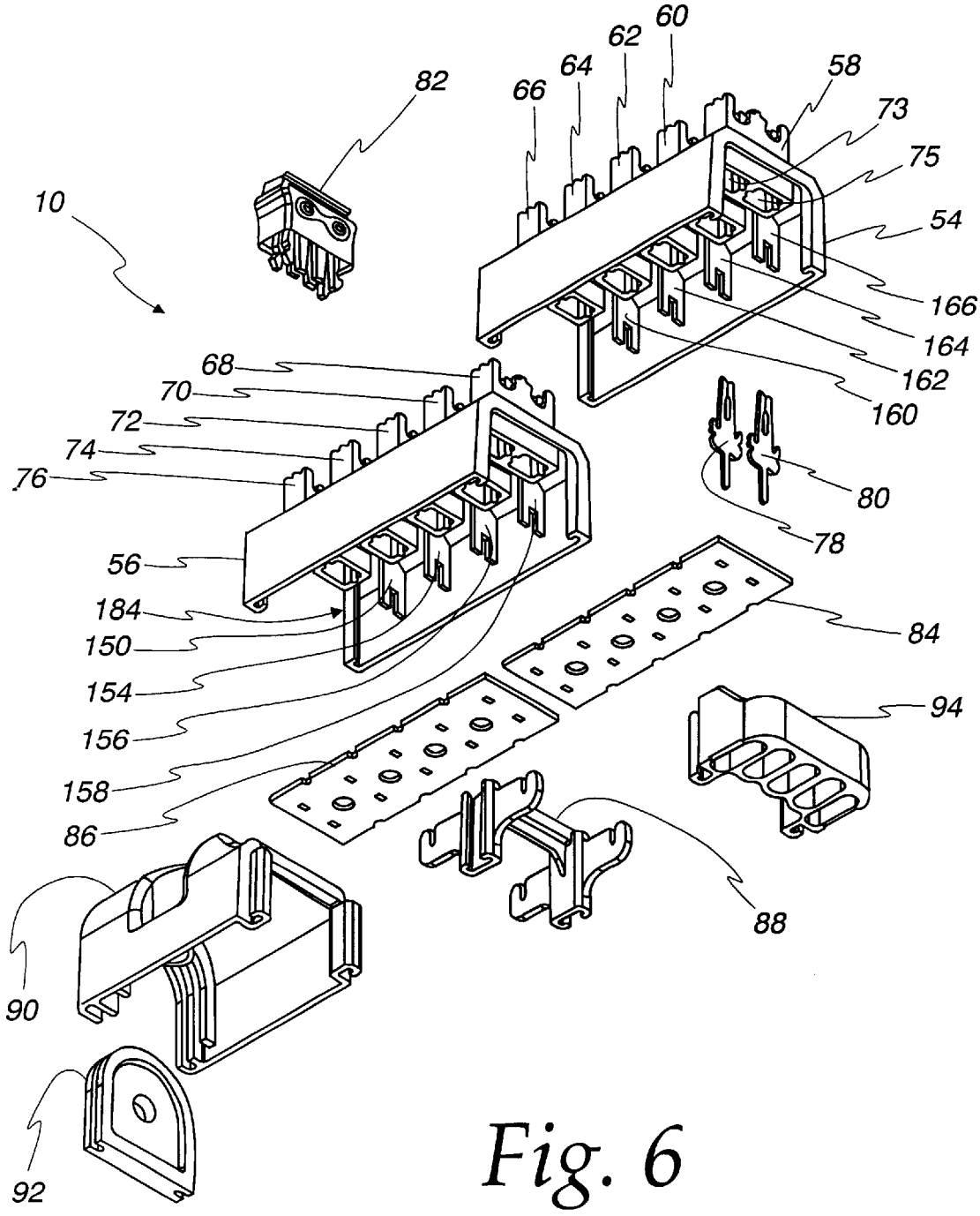
FIG. 6 is an exploded isometric view of a portion of the modular terminal block assembly shown in FIGS. 1–5.
Figure 7:
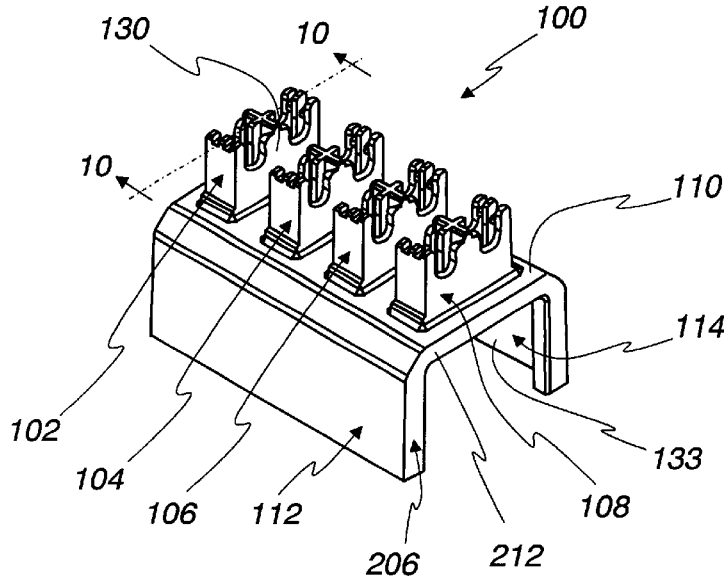
FIG. 7 is a downward looking isometric view of a four line pair shell for a modular terminal block assembly.
Figure 8:
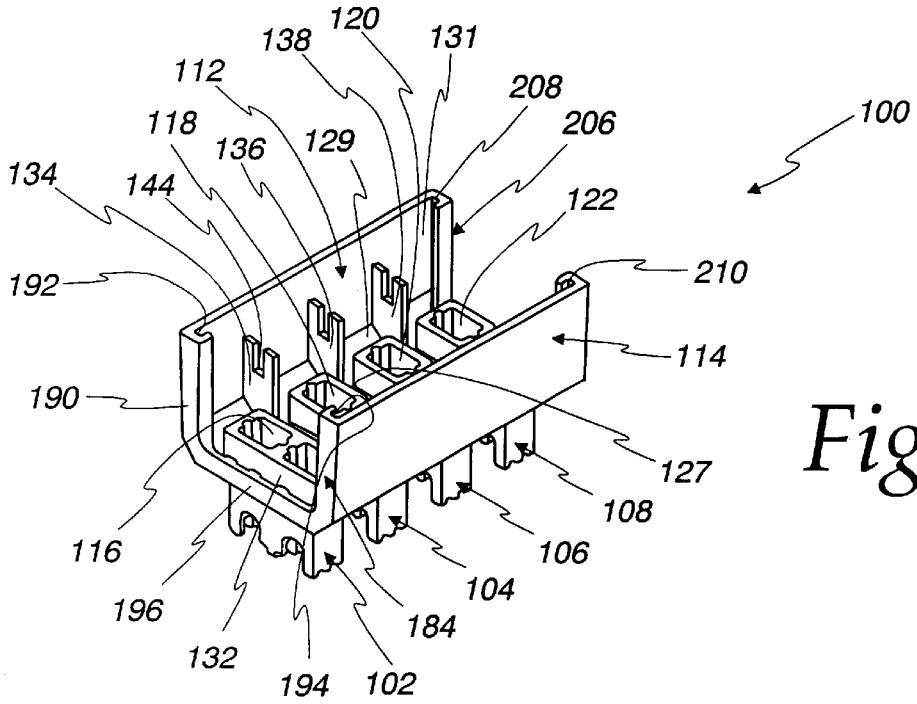
FIG. 8 is an upward looking isometric view of the modular shell shown in FIG. 7.
Figure 9:
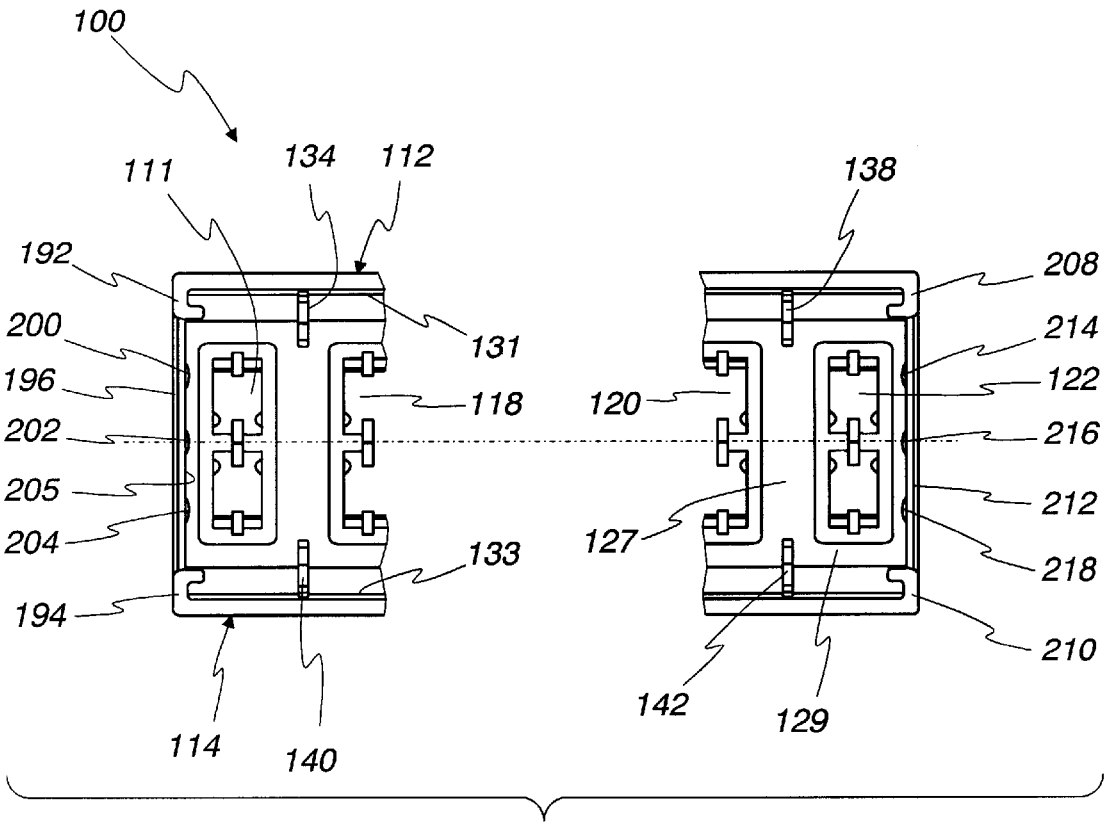
FIG. 9 is a bottom plan view of the modular shell shown in FIGS. 7 and 8 partially broken away.

Referring now to FIGS. 7–10, a modular shell 100 is described in more detail. It is noted that the modular shell illustrated in FIGS. 7 and 8 is essentially identical to the modular shells shown in FIGS. 1–6 except that the shell of FIGS. 7 and 8 has four insulation displacement connector housings 102, 104, 106, 108 instead of five. The modular shell 100 includes a base wall 110 and two opposing side walls 112, 114 extending downwardly from the base wall. For purposes here, the orientation of the modular terminal block assembly is considered to be upright in the views shown in FIGS. 1 and 2. It is noted, however, that the modular terminal block assembly in use may be connected to a supporting structure, such as a mounting plate of a pedestal, in a horizontal position, an upside down position or in a vertical orientation without affecting the operation of the assembly or the inventive concepts here. Pedestals of the type referred to here are disclosed in U.S. Pat. Nos. 6,182,846; 6,198,041; 6,455,772 and 6,462,269.

Integral with the walls are the four insulation displacement connector housings 102, 104, 106, 108 with each of the housings including a pair of chambers 116, 118, 120, 122 for mounting a pair of insulation displacement connectors, such as the pair 124, 126. Each housing includes an upper portion, such as the upper portion 130 of the housing 102 extending above the base wall 110 and a lower portion 132 extending below the base wall and between the two side walls. Around the lower portion of each housing is a recess 127 which extends between the housing and the side walls and is labeled recess 129. As explained below the recess will be filled with potting compound. Extending perpendicular from inner surfaces 131,133 of each side wall are a series of partitions, such as the partitions 134, 136, 138, 140, 142, each with an open vertically oriented slot, such as the slot 144 of the partition 134. It is noted that in the modular shell illustrated in FIGS. 7 and 8, there are three partitions integral with each side wall and the base wall whereas in the modular shells shown in FIG. 6, for example, there are four partitions 150, 154, 156, 158, 160, 162, 164, 166, 168, 170, 172, 174, 176, 178, 180, 182, FIGS. 4 and 6, integral with each side wall and basewall.

At a first end portion 184 of the modular shell 100 is a first connector element 190 integral with the side and base walls. The first connector element is in the form of U-shaped channels 192,194, and a flange 196 extending downwardly from the base wall. The flange cooperates with the nearest housing, housing 102 for example, when connected to a universal connector. To help forge a good friction fit, three protrusions 200, 202, 204 are formed on an inside wall 205 of the flange. At the other end of the modular shell is a second connector element 206 having an identical but mirror image U-shaped channels 208, 210, flange 212 and protrustions 214, 216, 218.

Figure 10:
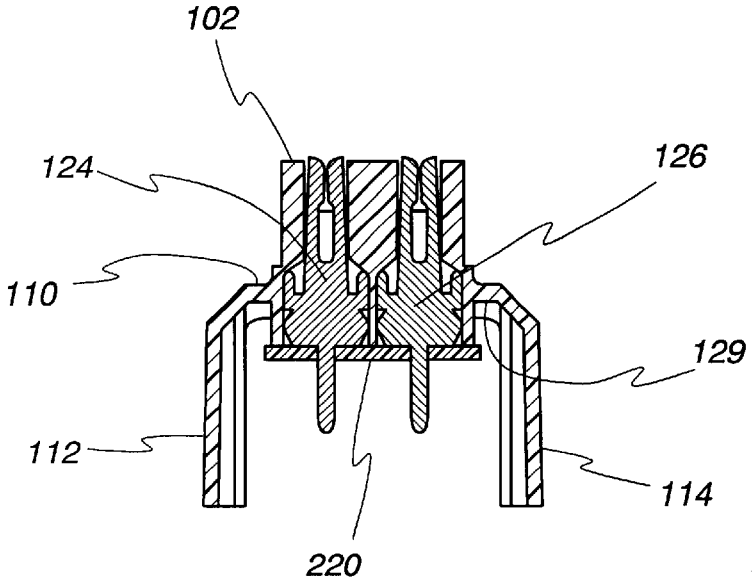
FIG. 10 is a section view of the shell taken along line 10—10 of FIG. 7 and also including a pair of insulation displacement connectors and a barrier strip.

It should be noted that the sectional view of FIG. 10 illustrates not only the modular shell but also the location of a pair of insulation displacement connectors 124,126 as well as an attached barrier strip 220.

Figure 12:
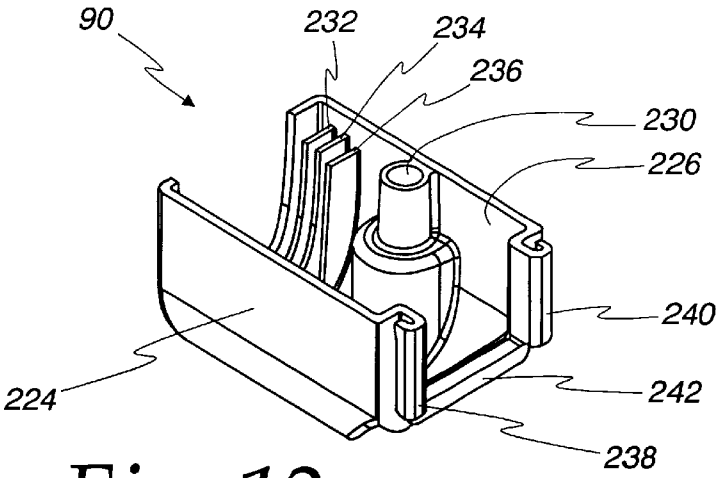
FIG. 12 is a downward looking isometric view of the cable end shell shown in FIG. 11 after the end shell has been turned upside down.
Figure 11:
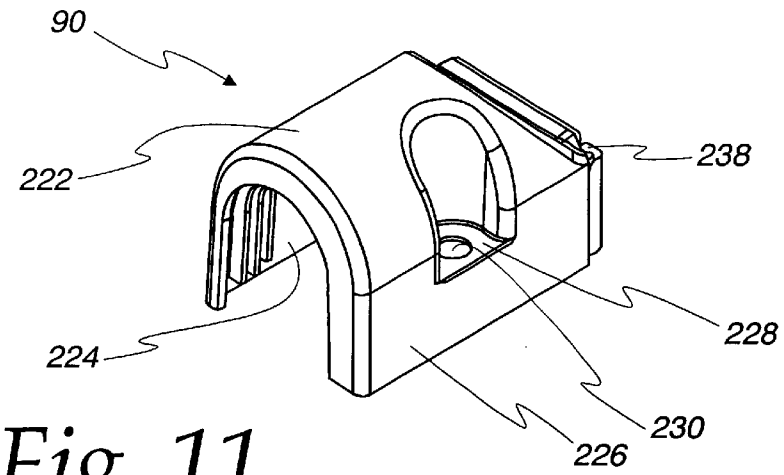
FIG. 11 is a downward looking isometric view of a cable end shell of the modular terminal block assembly shown in FIGS. 1–6.

The cable end shell 90 illustrated in FIGS. 11 and 12 including a domed upper wall 222 and two side walls 224, 226. There is also a depression 228 and a fastener aperture 230 which may be used to attach the modular terminal block assembly to a frame or plate of the type, for example, found in outdoor pedestals, as mentioned.

Within the interior of the cable end shell are a series of flanges 232, 234, 236. At the opposite end is a combination of oppositely disposed channel members 238, 240 integral with the side walls and an upwardly extending flange 242. The channel members and the upward extending flange mate with and engage the connector elements of a modular shell, as shown in FIGS. 4 and 6.

Figure 14:
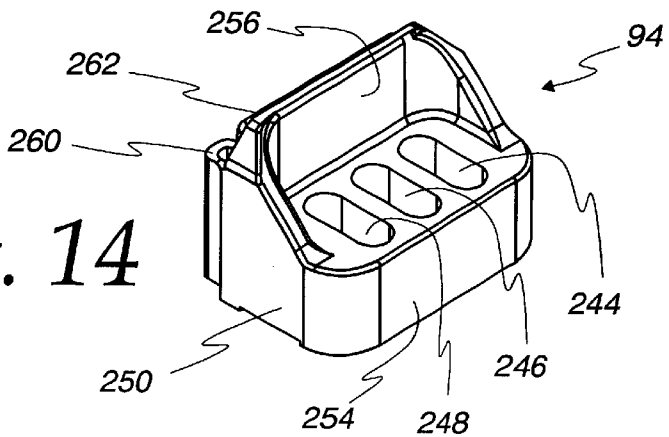
FIG. 14 is a downward looking isometric view of the end shell shown in FIG. 13 after rotation of one hundred eighty degrees.
Figure 13:
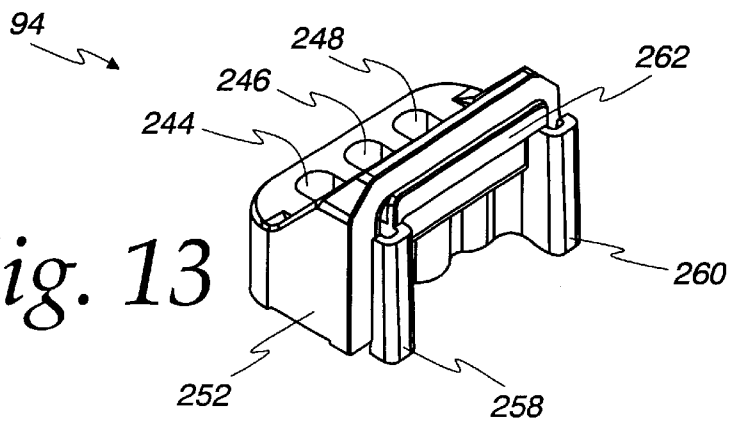
FIG. 13 is a downward looking isometric view of a small end shell of the modular terminal block assembly shown in FIGS. 1–6.

Referring now to FIGS. 13 and 14, the smaller end shell 94 is illustrated having a series of three apertures 244, 246, 248 surrounded by two oppositely disposed side walls 250, 252 and an end wall 254. Extending upwardly, opposite the end wall 254 is a protective wall 256. As with the cable end shell, the small end shell includes a connector element having a pair of channel members 258, 260 and an upstanding flange 262. These are engageable with the connector elements of the modular shells as shown in FIG. 4. The cable end shell 90 is connected to an end of the modular shell 56 and the smaller end shell 94 is connected to the modular shell 54.

The universal connector 88 is shown in more detail in FIGS. 15–19. The connector includes two pillars 270, 272 and a bridge member 274. The pillars are formed as oppositely disposed channels 276, 278, 280, 282 and the bridge portion has two upstanding flanges 284, 286. These engage the connector elements of aligned modular shells so as to connect two shells end to end as shown, for example, in FIGS. 1, 2, 3 and 4. The channels have slight nubbins 288, 290 at their lower portions 292, 294 to ensure a tight fit. The flanges are received by the modular shells between the bottom portion 132 of the housings 102, 108 and the depending walls 196, 212 so that a functional engagement is achieved especially with the protrusions 200, 202, 204, 214, 216, 218.

Figure 16:
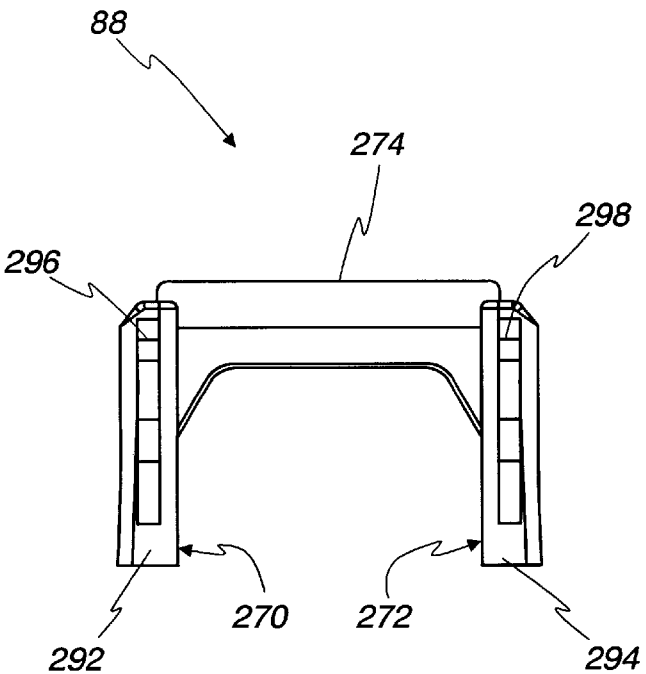
FIG. 16 is a front elevation view of the universal connector shown in FIG. 15.
Figure 15:
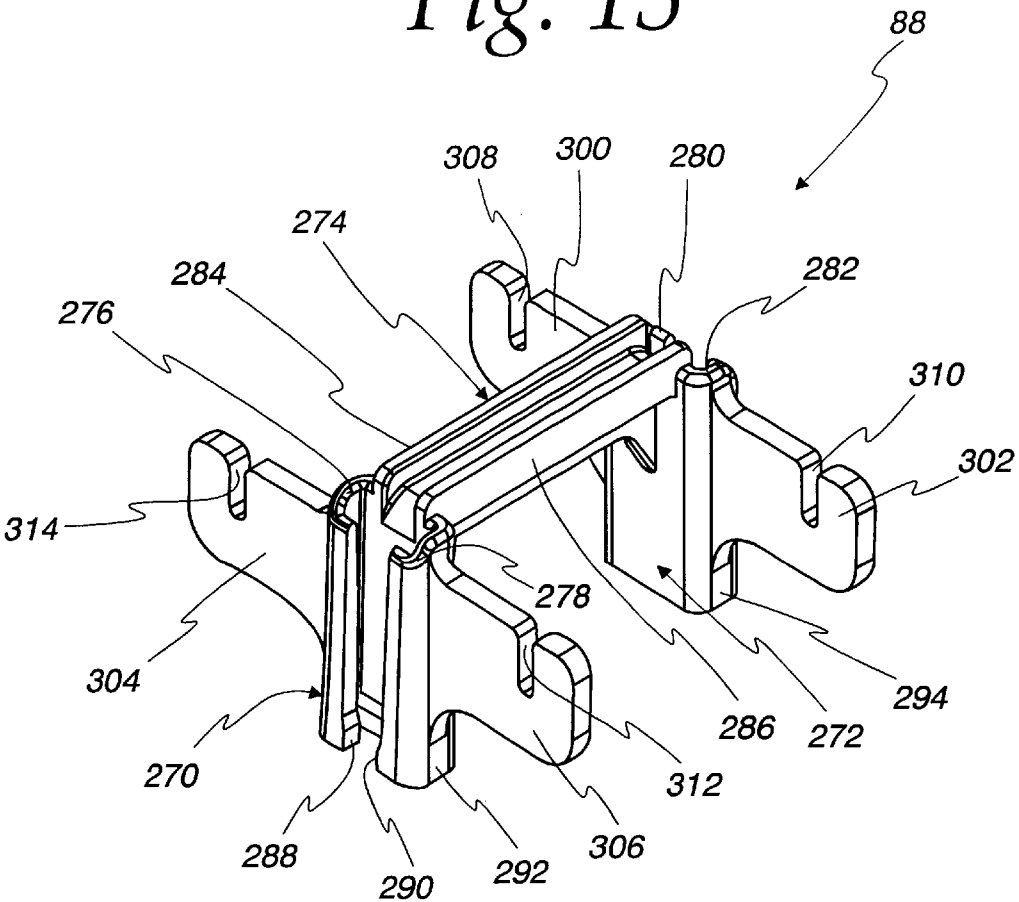
FIG. 15 is a downward looking isometric view of a universal connector of the modular terminal block assembly shown in FIGS. 1–6.
Figure 19:
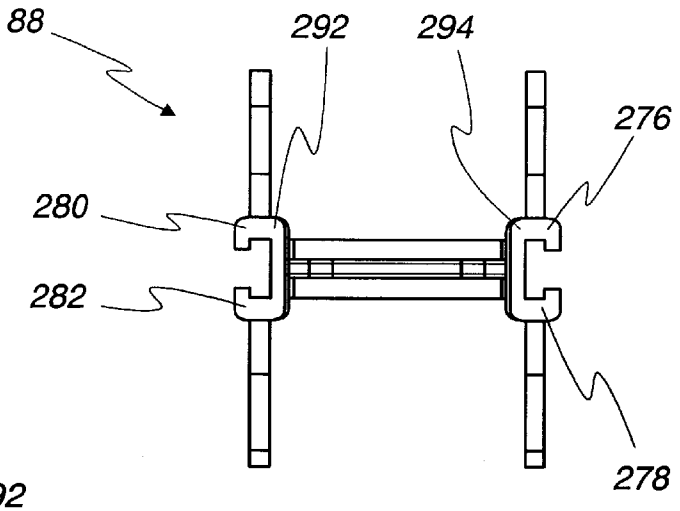
FIG. 19 is a bottom plan view of the universal connector shown in FIGS. 15–18.
Figure 18:
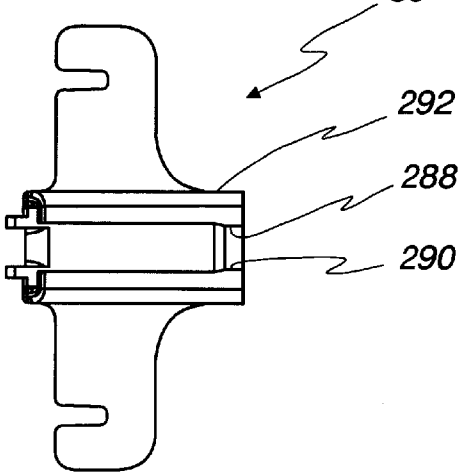
FIG. 18 is a side elevation view of the universal connector shown in FIGS. 15–17.
Figure 17:
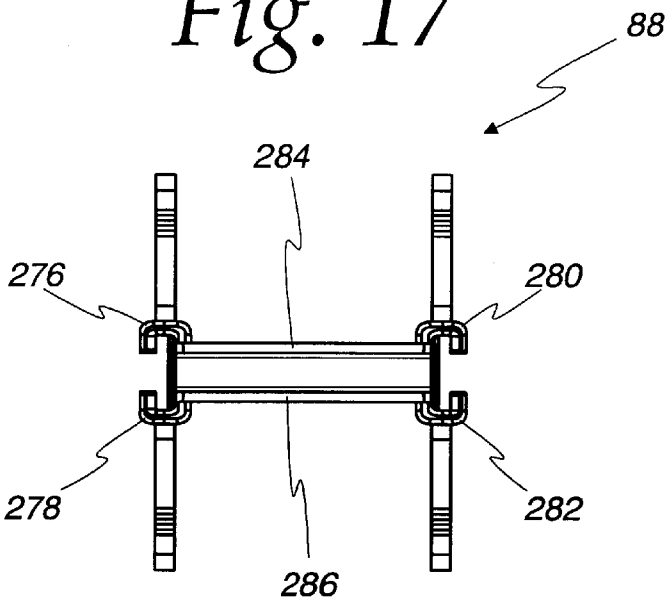
FIG. 17 is a top plan view of the universal connector shown in FIGS. 15 and 16.
Figure 21:
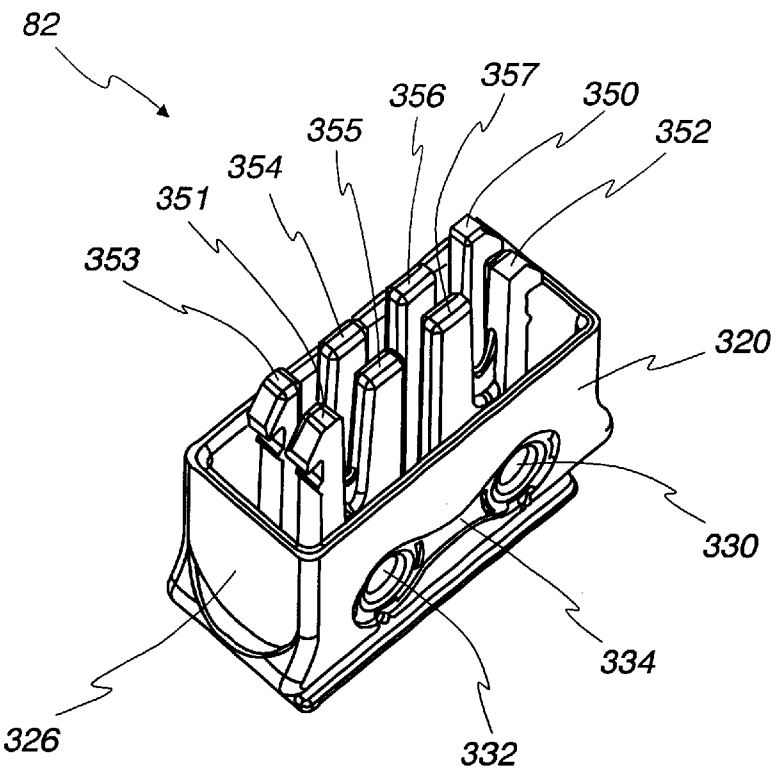
FIG. 21 is an downward looking isometric view of the activator shown in FIG. 20 after being turned upside down.
Figure 20:
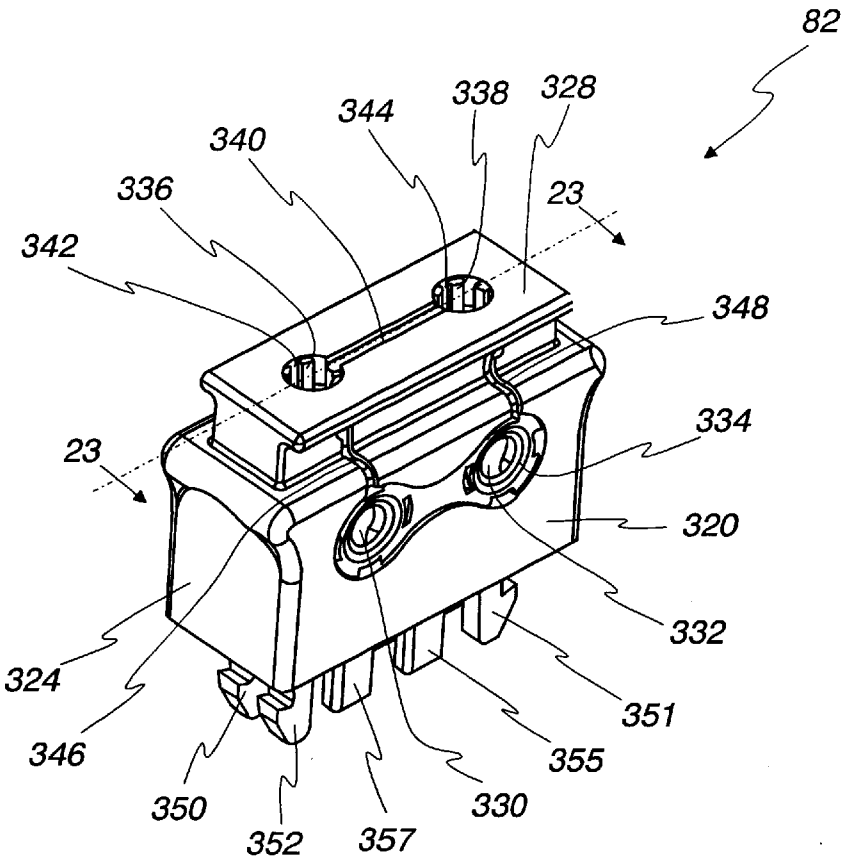
FIG. 20 is a downward looking front isometric view of an activator.
Figure 23:
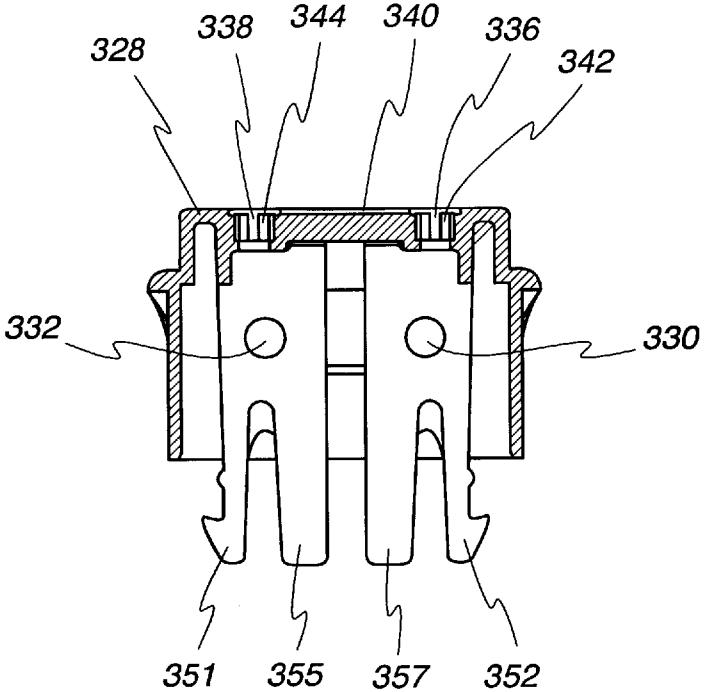
FIG. 23 is a sectional view taken along line 23—23 of FIG. 20.
Figure 22:
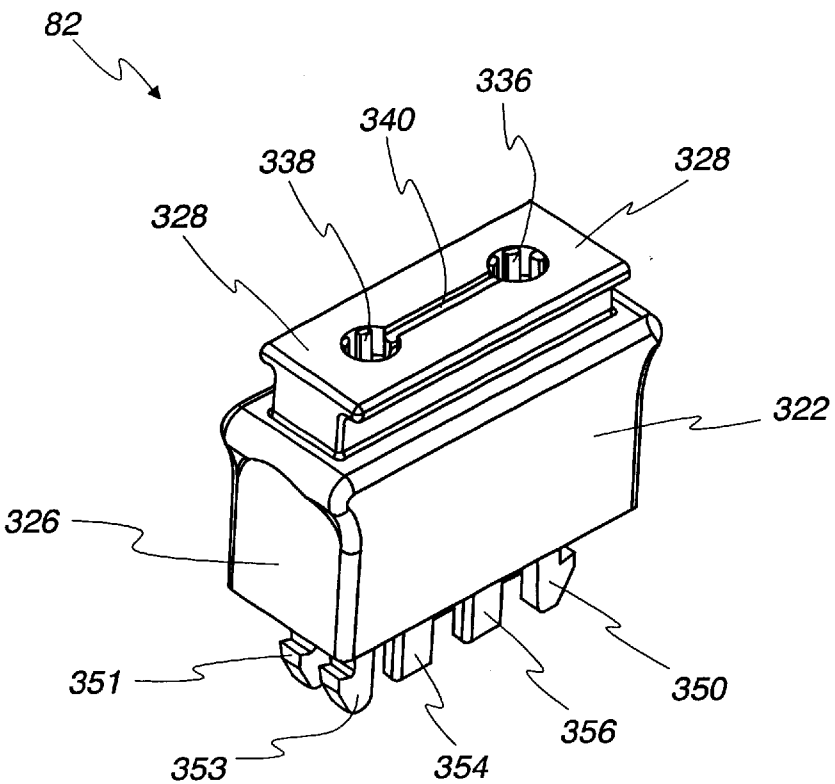
FIG. 22 is a downward looking rear isometric view of the activator shown in FIGS. 20 and 21.
Figure 25:
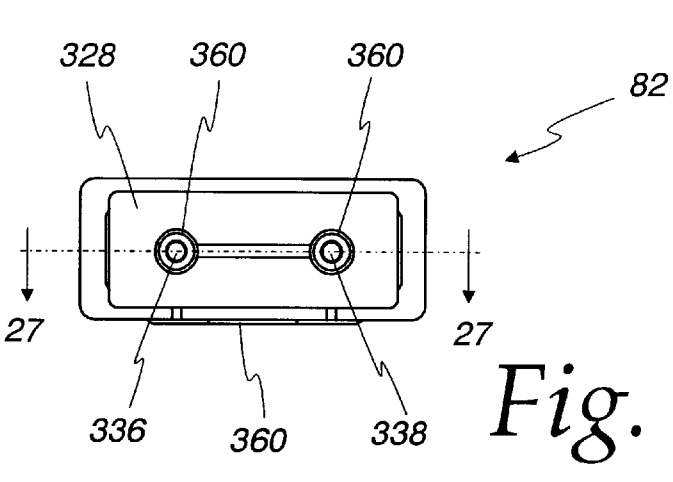
FIG. 25 is a top plan view of the actuator with a overmolded seal.
Figure 24:
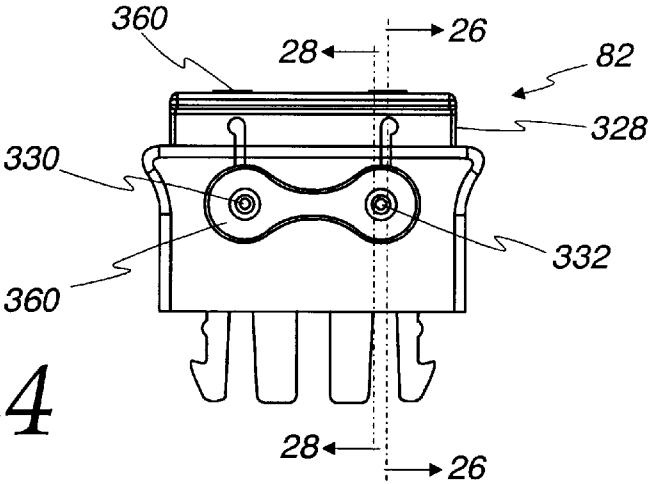
FIG. 24 is front elevation view of the actuator with a overmolded seal.
Figure 28:
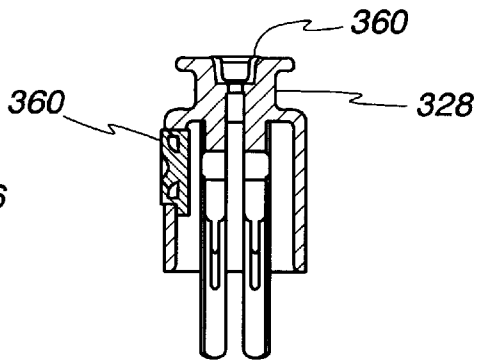
FIG. 28 is a sectional elevation view taken along line 28—28 of FIG. 24.
Figure 27:
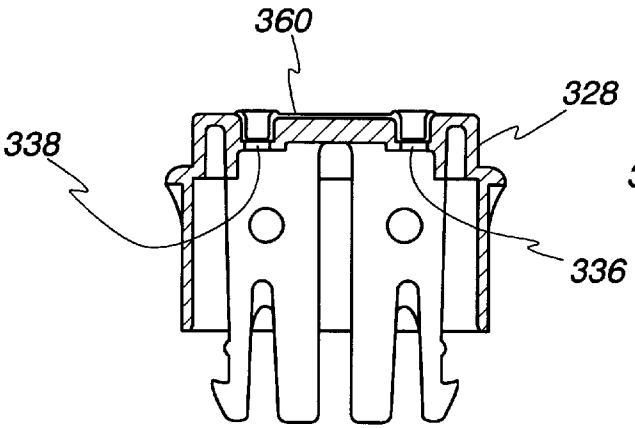
FIG. 27 is a sectional elevation view taken along line 27—27 of FIG. 25.
Figure 26:
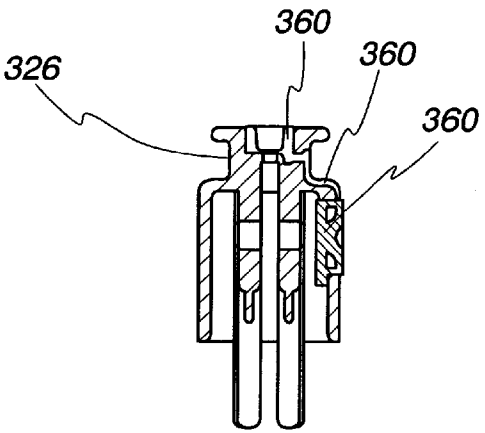
FIG. 26 is a sectional elevation view taken along line 26—26 of FIG. 24.

As shown in FIG. 16, the pillars have an outside surface that is slightly tapered, being wider at the lower end portions 292, 294, than at the top end portions 296, 298. Extending from each pillar are arms 300, 302, 304, 306 that extend in the longitudinal direction of the modular shells, namely, in a direction parallel to the side walls of the modular shells. Each of the arms includes an open vertically disposed slot 308, 310, 312, 314, which when connected to a modular shell engages the vertical open slots, such as the slot 144, FIG. 8, of the closest two partitions to the end portions of the modular shells, such as shown in FIG. 4. The placement of the universal connector relative to the modular shells provides for spaces between the connector arms and the side walls of the shells as well as a space above the arms up to the base wall of a connected modular shell. There is also a space between a bottom edge of the arm and the bottom edge of the side walls of the modular shell. These spaces are provided so that the potting compound 95 can flow around the universal connector arms and around their engagement with the partitions so as to act as a reinforcement element to the potting compound and thereby provide a strong, robust and stiff assembly. The potting compound is usually poured into the spaces and then left to cure to a relatively hard, permanent material.

Referring now to FIGS. 20–23, the activator 82 is shown in greater detail. The activator includes a front wall 320, a back wall 322, two side walls, 324, 326 and a crown handle 328. Located in the front wall are two apertures 330, 332 surrounded by a mold receiving recess 334. The apertures are provided for allowing the insertion of electrical conductors to make contact with a pair of insulation displacement connectors which are mounted in the housings of the modular shell to which the activator is slideably engaged. In the crown are two vertically aligned test ports 336, 338. Connecting the test ports is a runner 340 and around each test port is a sleeve-like mold receiving opening 342, 344. Connecting the test ports and the apertures are mold material runners 346, 348.

The activator also include two pairs of displaceable hooks 350, 351, 352, 353 for engaging the housing and two pairs of guide panels 354, 355, 356, 357 for aligning the activator in the housing. When mounting the activator the hooks flex inwardly until they are able to snap back to their original position thereby restraining the activator when it is elevated to insert or disengage conductors.

Referring now to FIGS. 24–28, a molded grommet 360 is shown which covers both the apertures 330, 332 in the front wall 320 , the test ports 336, 338 in the crown 328 and the runners 340, 346, 348. The materials used is liquid silicon rubber which may be provided by the General Electric Company. The silicon rubber, when cured, seals the interior portions of the activator and greatly reduces the likelihood that grease or other material will be ejected or leaked from activator or housing. The cured silicon rubber, however, may be pierced by conductors or test equipment so that electrical connections can still be made. However, any openings made tend to self seal so as to trap the grease within the activator. The silicon rubber also wipes the conductors during disengagement. This action also retains the grease inside the activator. Furthermore, the silicon rubber acts as a strain relief for the inserted conductors. These are major features of the disclosed assembly.

Figure 30:
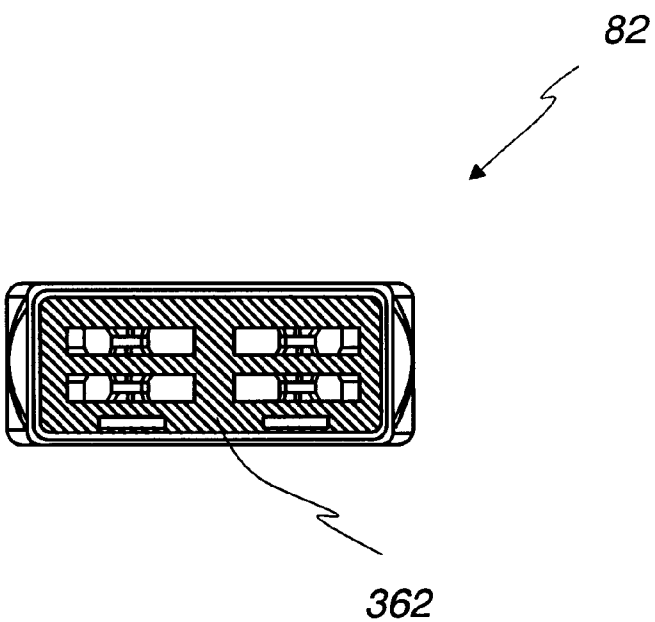
FIG. 30 is a bottom plan view of the activator illustrating the placement of grease.
Figure 29:
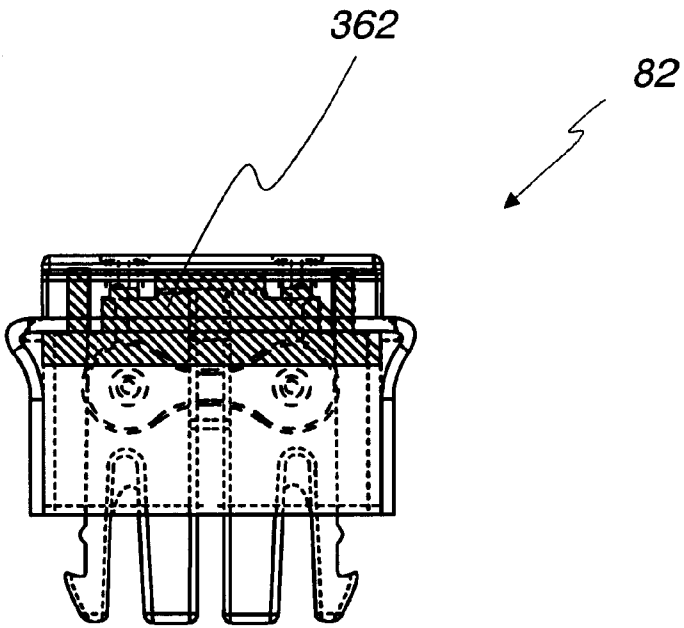
FIG. 29 is a diagrammatic elevation view of the activator illustrating the placement of grease material in the activator.

FIGS. 29 and 30 illustrate the location, represented by the solid black region 362, where grease or gel or both are placed in the upper portion of the activator. The purpose of the grease is to provide a barrier around the connection of an electrical conductor and an insulation displacement connector so as to keep any moisture and other contamination away from the connection site. The grease (or gel) is electrically insulative and it complements the grease or gel deposited in the housing. As mentioned above, conductors may be inserted and removed a multiple number of times over the life of a terminal block assembly. The silicon rubber mold 360, FIGS. 24–28 provides a barrier against the grease leaking outwardly and yet access to the insulation displacement connectors is still maintained because wires or testing instruments may be punched through the silicon rubber. On removal of the wires, the silicon rubber acts as a wiping mechanism for wiping grease from the wires and the test apparatus so as to maintain the environmental integrity of the electrical connection.

In operation, a modular terminal block assembly is created by using modular shells and universal connectors to form the predetermined number of line pairs needed. The shells will have insulative displacement connectors installed and activators mounted. The end shells are attached so that the configuration exemplified by the assembly in FIG. 1 is reached. Thereafter, a potting compound is injected into the open underside of the modular shells and the end shells. The potting compound passes selectively through the barrier strips so as to fill the regions around the universal connector arms and the housings. A volume of potting compound sufficient to have the compound roughly even with the bottom surface of the modular shell side walls is injected. Thereafter, the compound is cured. What results is a very strong, stiff and robust terminal block assembly that is also economical to use. The potting compound acts like concrete around rebars where the arms of the universal connectors and the partitions are the rebars.

The above specification describes in detail the preferred embodiment of the present invention. Other examples, embodiments, modifications and variations will, under both the literal claim language and the doctrine of equivalents, come within the scope of the invention defined by the appended claims. For example, modular shells with more or less than five housings may be used to build an assembly and other forms of end shells may be used. The shapes of the housings and activators may vary as may the shape of the insulative displacement connectors. All of these are still considered to be equivalent structures. Further, they will come within the literal language of the claims. Still other alternatives will also be equivalent as will many new technologies. There is no desire or intention here to limit in any way the application of the doctrine of equivalents nor to limit or restrict the scope of the invention as expressed by the claims.

What is claimed is:

1. A modular terminal block assembly comprising in combination:

a first modular shell having a base, and opposing side walls extending downwardly from said base wall, an insulation displacement connector housing mounted to said base and including two chambers in said housing for receiving two insulation displacement connectors, a first connector element at one end portion of said modular shell, a second connector element at a second end portion of said modular shell, and a plurality of partitions extending from each side wall toward the other side wall;

a first pair of insulation displacement connectors mounted in said two chambers of said housing of said first modular shell;

a second modular shell having a base, and opposing side walls extending downwardly from said base wall, an insulation displacement connector housing mounted to said base wall and including two chambers in said housing for receiving two insulation displacement connectors, a first connector element at one end portion of said second modular shell, a second connector element at a second end portion of said second modular shell, and a plurality of partitions extending from each side wall toward the other side wall, the second modular shell being essentially identical to said first modular shell;

a second pair of insulation displacement connectors mounted in said two chambers of said housing of said second modular shell;

a first end element having a connector element engageable with one of the connector elements of said first or said second modular shell;

a second end element having a connector element engageable with the other of the connector elements of said first or said second modular shell;

a universal connector for joining said first and said second modular shells, said universal connector having two complementary connector elements, each to engage one of the connector elements of said first and said second modular shells, and said universal connector also having two pair of parallel extending arms, said arms being disposed parallel to said opposing side walls of said modular shells, and each of said arms being engageable with a partition;

first and second activators being operatively engaged with each of the insulation displacement connector housings of said first and said second modular shell for facilitating the connection of electrical conductors with said insulation displacement connectors, said activators including insulative material molded in portions of said activator;

a first barrier strip connected to said first modular shell, said first barrier strip having openings and slots for receiving said insulation displacement connectors and said partitions and for allowing the passage of a protective insulative material, said first barrier strip being positioned between said side walls and abutting said insulation displacement connector housing of said first modular shell;

a second barrier strip connected to said second modular shell, said second barrier strip having openings and slots for receiving said insulation displacement connectors and said partitions and for allowing the passage of a protective insulative material, said second barrier strip being positioned between said side walls and abutting said insulation displacement connector housing of said second modular shell;

insulative material located in said housings of said modular shells and around said insulation displacement connectors above said barrier strips and in said activators, said insulative material allowing for the passage of electrical conductors to and from said insulation displacement connectors; and a protective insulative material located below said barrier strips and between said side walls and above said barrier strips and between said housings and said side walls and around said partitions and said arms of said universal connector, said protective insulative material being harder than said insulative material located in said housing.

2. The apparatus as claimed in claim 1 wherein:

said connector elements of said modular shells include channel shaped end walls integral with said side walls.

3. The apparatus as claimed in claim 2 wherein:

said connector elements of said modular shells include an end wall depending from said base wall.

4. The apparatus as claimed in claim 3 wherein:

said depending end wall includes a protrusion.

5. The apparatus as claimed in claim 1 wherein:

a first portion of said housing extends above said base wall and a second portion of said housing extends below said base wall.

6. The apparatus as claimed in claim 1 wherein:

said housing is spaced from said side walls and other housings to provide a recess around said housing.

7. The apparatus as claimed in claim 1 wherein:

said plurality of partitions extend generally perpendicular from inside surfaces of said side walls.

8. The apparatus as claimed in claim 1 wherein:

each of said plurality of partitions includes an open connector slot.

9. The apparatus as claimed in claim 1 wherein:

each of said plurality of partitions is integral with one of said side walls and said base wall.

10. The apparatus as claimed in claim 4 wherein:

a first portion of said housing extends above said base wall and a second portion of said housing extends below said base wall.

11. The apparatus as claimed in claim 10 wherein:

said housing is spaced from said side walls and other housings to provide a recess around said housing.

12. The apparatus as claimed in claim 11 wherein:

said plurality of partitions extends generally perpendicular from inside surfaces of said side walls.

13. The apparatus as claimed in claim 12 wherein:

each of said plurality of partitions includes an open connector slot.

14. The apparatus as claimed in claim 4 wherein:

said plurality of partitions extends generally perpendicular from inside surfaces of said side walls.

15. The apparatus as claimed in claim 14 wherein:

each of said plurality of partitions includes an open connector slot.

16. The apparatus as claimed in claim 1 wherein:

said connector element of each of said end shells includes a channel shaped end portion engageable with the connector elements of said modular shells.

17. The apparatus as claimed in claim 16 wherein:

said connector element of each of said end shells includes an upstanding flange.

18. The apparatus as claimed in claim 17 wherein:

said connector elements of said modular shells includes channel shaped end walls integral with said side walls.

19. The apparatus as claimed in claim 18 wherein:

each of said connector elements of said modular shells includes an end wall depending from said base wall.

20. The apparatus as claimed in claim 19 wherein:

each of said depending end walls of said modular shells includes a protrusion.

21. The apparatus as claimed in claim 20 wherein:

said channel shaped end portions of each of said end channels are engageable with said channel shaped end walls of said modular shells.

22. The apparatus as claimed in claim 21 wherein:

each of said depending end walls of said modular shells and an adjacent housing are adapted to receive an upstanding flange from an end shell and frictionally engage the upstanding flange.

23. The apparatus as claimed in claim 1 wherein:

said universal connector includes oppositely facing channel shaped portions engageable with connector elements of said modular shells.

24. The apparatus as claimed in claim 23 wherein:

said universal connector includes two upstanding flanges parallel to each other.

25. The apparatus as claimed in claim 1 wherein:

said arms of said universal connector includes open slots.

26. The apparatus as claimed in claim 25 wherein:

said universal connector includes oppositely facing channel shaped portions engageable with connector elements of said modular shells; and said universal connector includes two upstanding flanges parallel to each other.

27. The apparatus as claimed in claim 1 wherein:

when connected to a modular shell, each of said arms of said universal connector is spaced from said side walls, said base wall, said housing and bottom edges of said side walls.

28. The apparatus as claimed in claim 27 wherein:

said universal connector includes oppositely facing channel shaped portions engageable with connector elements of said modular shells; and said universal connector includes two upstanding flanges parallel to each other.

29. The apparatus as claimed in claim 28 wherein:

said arms of said universal connector include open slots.

30. The apparatus as claimed in claim 1 wherein:

said activator includes conductor apertures and test ports; and a molded material formed in said conductor apertures and in said test ports.

31. The apparatus as claimed in claim 5 wherein:

said barrier strips are disposed abutting said housing second portion.

32. The apparatus as claimed in claim 1 wherein:

said connector elements of said modular shells include channel shaped end walls integral with said side walls and an end wall depending from said base wall;

a first portion of said housing extends above said base wall and a second portion of said housing extends below said base wall;

said housing is spaced from said side walls and other housings to provide a recess around said housing;

said plurality of partitions extend generally perpendicular from inside surfaces of said side walls;

each of said plurality of partitions includes an open connector slot;

said connector element of each of said end shells includes a channel shaped end portion engageable with the connector elements of said modular shell;

said connector element of each of said end shells includes an upstanding flange;

said universal connector includes oppositely facing channel shaped portion engageable with connector elements of said modular shells;

said universal connector includes two upstanding flanges parallel to each other;

said arms of said universal connector include open slots;

when connected to a modular shell each of said arms of said universal is spaced from said side walls, said base wall, said housing and bottom edges of said side walls;

said activator includes conductor apertures and test ports;

a molded material formed in said conductor apertures and in said test ports; and said barrier strips are disposed abutting said housing second portion.

* * * * *